US010478955B2

(12) United States Patent
Conkin

(10) Patent No.: US 10,478,955 B2
(45) Date of Patent: Nov. 19, 2019

(54) TOOL FOR RELEASABLY RETAINING A RAILWAY SPIKE

(71) Applicant: David William Conkin, Chilliwack (CA)

(72) Inventor: David William Conkin, Chilliwack (CA)

( * ) Notice: Subject to any disclaimer, the term of this patent is extended or adjusted under 35 U.S.C. 154(b) by 103 days.

(21) Appl. No.: 15/583,912

(22) Filed: May 1, 2017

(65) Prior Publication Data

US 2018/0313040 A1 Nov. 1, 2018

(51) Int. Cl.

| | |
|---|---|
| ***E01B 29/26*** | (2006.01) |
| ***B25C 3/00*** | (2006.01) |
| ***E01B 29/24*** | (2006.01) |

(52) U.S. Cl.

CPC ..... *B25C 3/008* (2013.01); *E01B 29/24* (2013.01)

(58) Field of Classification Search

None

See application file for complete search history.

(56) References Cited

U.S. PATENT DOCUMENTS

| | | | | |
|---|---|---|---|---|
| 337,905 | A * | 3/1886 | Wheelock | B25C 3/008 81/44 |
| 1,916,708 | A | 7/1933 | Zavatkay | |
| 2,420,869 | A * | 5/1947 | Davis | B25C 3/008 81/44 |
| 2,480,519 | A | 8/1949 | Talboys et al. | |
| 2,849,714 | A | 9/1958 | Allen | |
| 3,010,408 | A | 11/1961 | Godfrey | |
| 4,525,889 | A * | 7/1985 | Dunau | A46B 17/02 15/143.1 |
| 4,784,025 | A | 11/1988 | Peck | |
| 7,467,573 | B1 * | 12/2008 | Lee | B25C 3/008 81/44 |

OTHER PUBLICATIONS

WIPO, Canadian International Searching Authority, International Search Report, dated Jul. 25, 2018 in PCT International Application No. PCT/CA2018/050517, 3 pages.

WIPO, Canadian International Searching Authority, Written Opinion of the International Searching Authority, dated Jul. 25, 2018 in PCT International Application No. PCT/CA2018/050517, 3 pages.

* cited by examiner

*Primary Examiner* — Brian D Keller

(74) *Attorney, Agent, or Firm* — Cameron IP

(57) ABSTRACT

A tool comprises a handle and a tool head at an end of the handle. The tool head has a channel for receiving a fastener. There is a resilient member disposed along a length of an inner surface of a wall defining the channel. The resilient member may be retained by a recess in an edge of the wall defining the channel. The channel may be defined by a first wall and a second wall and a web extending between the first wall and the second wall. The resilient member may be disposed along an inner surface of the first wall. There may be a lip extending along the second wall. The channel may alternatively be defined by a substantially tubular wall. The resilient member may be a spring disposed along an inner surface of the substantially tubular wall.

2 Claims, 10 Drawing Sheets

TOOL FOR RELEASABLY RETAINING A RAILWAY SPIKE

BACKGROUND OF THE INVENTION

Field of the Invention

The present invention relates to a tool for holding a fastener and, in particular, to a tool for holding a fastener in which a spring biases the fastener.

Description of the Related Art

U.S. Pat. No. 2,480,519 which issued on Aug. 30, 1949 to Talboys et al., and the full disclosure of which is incorporated herein by reference, discloses a spike holding tool provided with an efficient means for holding railroad spikes in position to be driven into the ties. In a first aspect the spike holding tool comprises a handle and a tool body at the lower end of the handle. The tool body has a supporting abutment means adapted to engage an upper surface of a rail flange and spring means for engaging and holding a spike. The tool body has fixed, generally perpendicular aligning faces adapted to maintain a spike in upright position for the initiation of the driving operation. The spring means is adapted to hold the spike in positioning contact with said aligning faces. In a second aspect the spike holding tool comprises a handle and a tool body at the lower end of the handle. There is a positioning block interpenetrating with a side of the tool body and means for removably holding the positioning block in position. The positioning block has generally perpendicular aligning faces arranged in intersecting planes and means for securing a spike releasably against the aligning faces. The means for securing a spike releasably against the aligning faces includes spring means secured to the tool body and a spike engaging portion.

SUMMARY OF THE INVENTION

There is provided a tool for holding a fastener. The tool comprises a handle and a tool head at an end of the handle. The tool head has a channel for receiving a fastener. There is a resilient member disposed along a length of an inner surface of a wall defining the channel. The resilient member may be retained by a recess in an edge of the wall defining the channel. The channel may be defined by a first wall and a second wall and a web extending between the first wall and the second wall. The resilient member may be disposed along an inner surface of the first wall. There may be a lip extending along the second wall. The channel may alternatively be defined by a substantially tubular wall. The resilient member may be a spring disposed along an inner surface of the substantially tubular wall.

There is also provided a tool for holding a fastener. The tool comprises a handle, and a tool head at an end of the handle. The tool head has a channel for receiving a fastener. The channel is defined by a first wall and a second wall and a web extending between the first wall and the second wall. A resilient member is disposed along an inner surface of the first wall. The resilient member is retained in a recess in an edge of the first wall. A lip extends along the second wall.

There is further provided a tool for holding a fastener. The tool comprises a handle and a tool head at an end of the handle. The tool head has a channel for receiving a fastener. The channel is defined by a substantially tubular wall and a resilient member is disposed along an inner surface of the substantially tubular wall. The resilient member is retained in a recess in an edge of the substantially tubular wall.

BRIEF DESCRIPTIONS OF DRAWINGS

The invention will be more readily understood from the following description of the embodiments thereof given, by way of example only, with reference to the accompanying drawings, in which.

DESCRIPTIONS OF THE PREFERRED EMBODIMENTS

Figure 1:
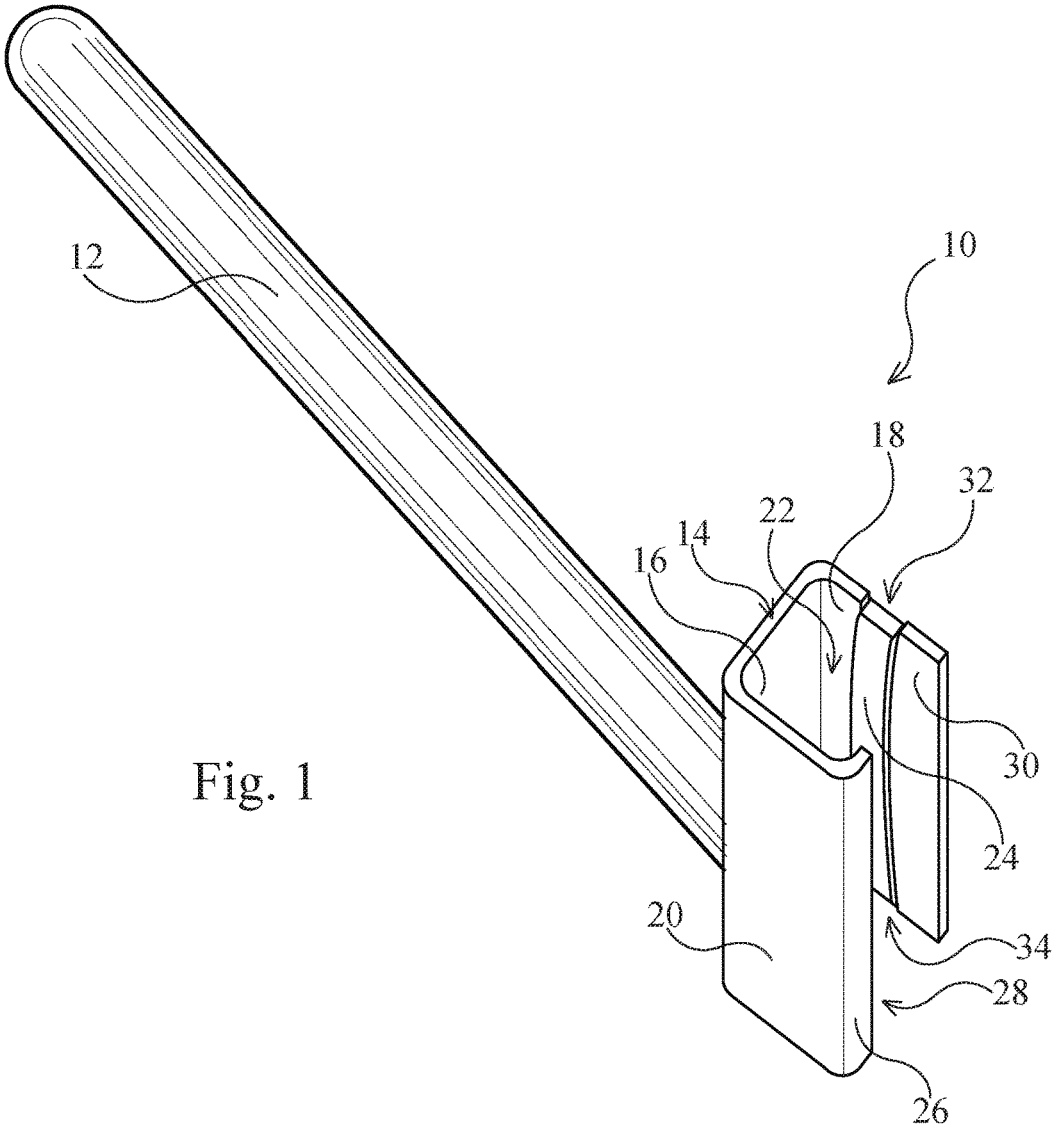
FIG. 1 is a perspective view of a tool for holding a fastener.
Figure 2:
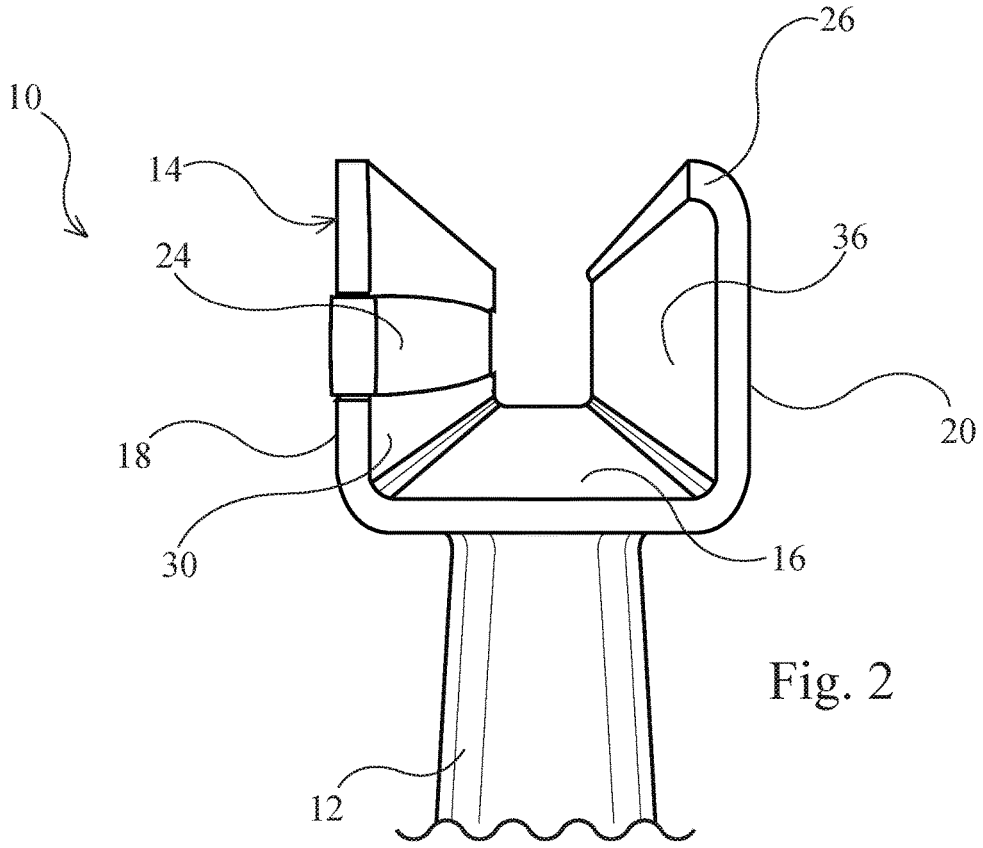
FIG. 2 is a top perspective view of a head of the tool of FIG. 1.

Referring to the drawings and first to FIG. 1 there is shown a tool 10 which comprises a handle 12 and a tool head 14. The handle 12 is conventional and extends angularly from the tool head 14. The tool head 14 head includes a web 16 and a first side wall 18 and a second side wall 20 extending from the web 16. The web 16 together with the first side wall 18 and the second side wall 20 define a channel 22 which is configured to receive a fastener (not shown in FIG. 1). The first side wall 18 is provided with a resilient member which, in this example, is a spring 24. The second side wall 20 is provided with a lip 26 which extends generally perpendicularly to the second side wall 20. There is an opening 28 between the first side wall and the lip 26 of the second side wall. The spring 24 is disposed along a length of an inner surface 30 of the first side wall 18. The spring 24 is retained by recesses 32 and 34 in the top and bottom edges of the first side wall 18. As best shown in FIG. 2, the second side wall 20 also has an inner surface 36. The inner surface 30 of the first side wall 18 faces the inner surface 36 of the second side wall 20.

Figure 3:
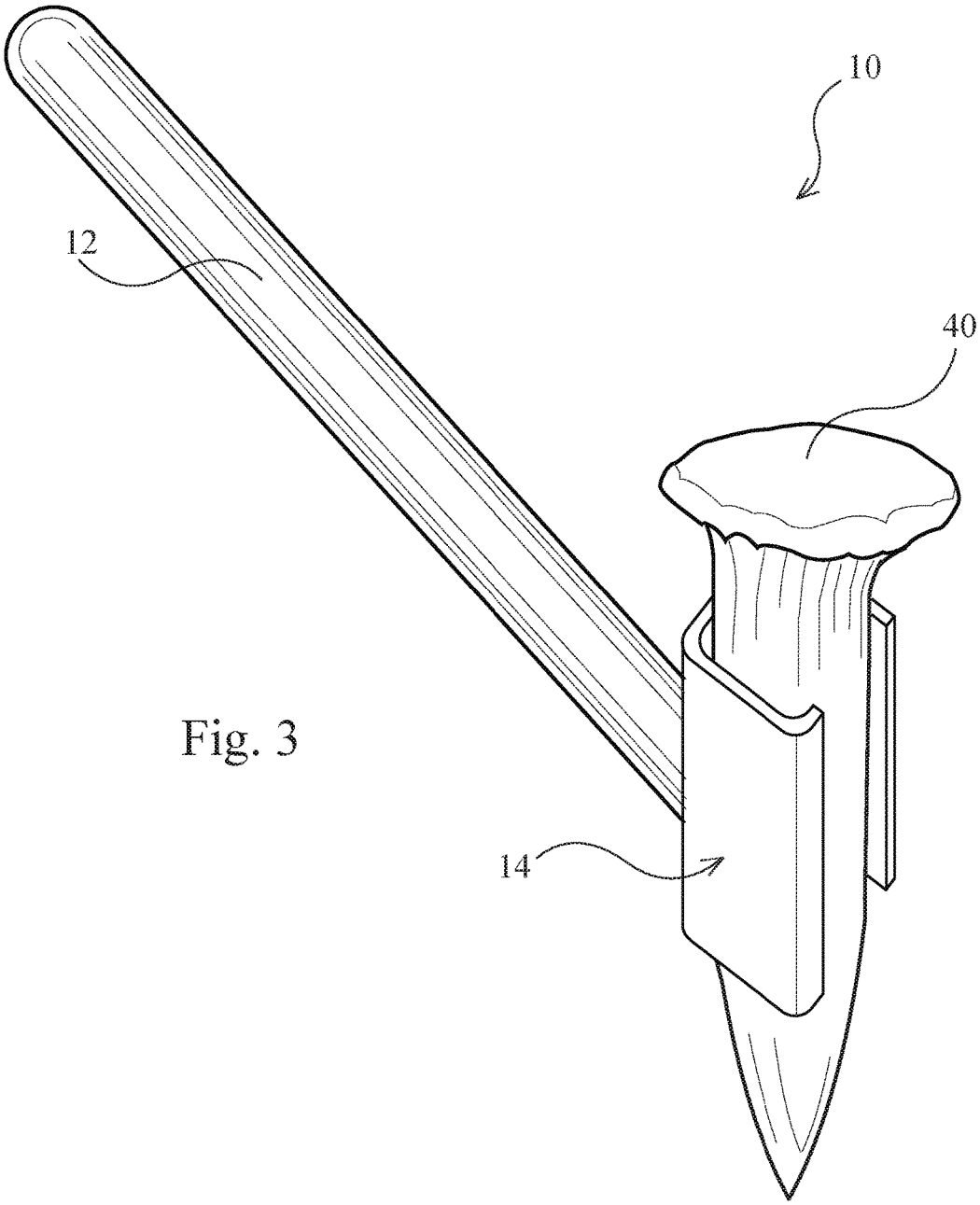
FIG. 3 is a perspective view of the tool of FIG. 1 holding a railway spike.
Figure 4:
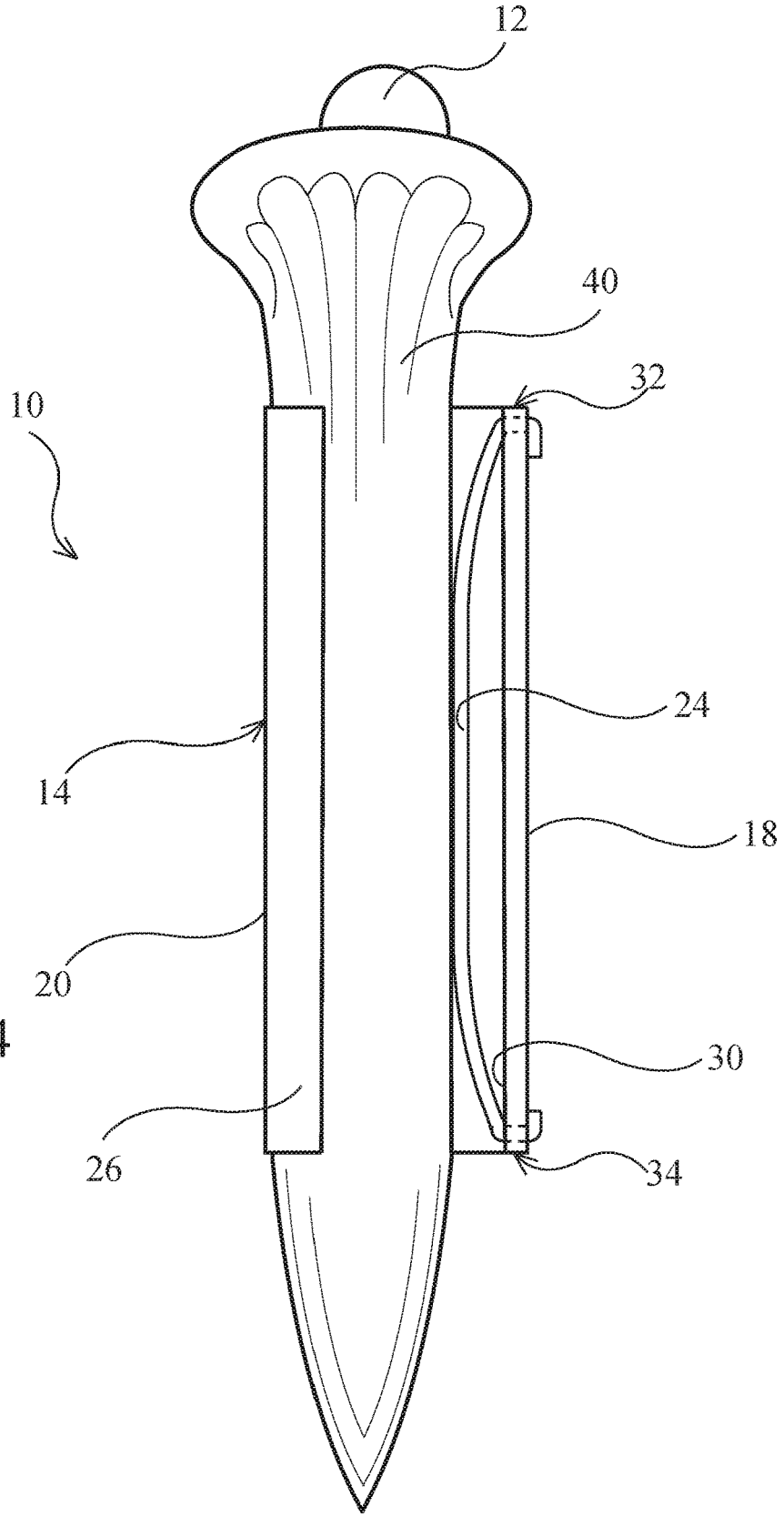
FIG. 4 is an elevation view of the tool of FIG. 1 holding the railway spike.
Figure 5:
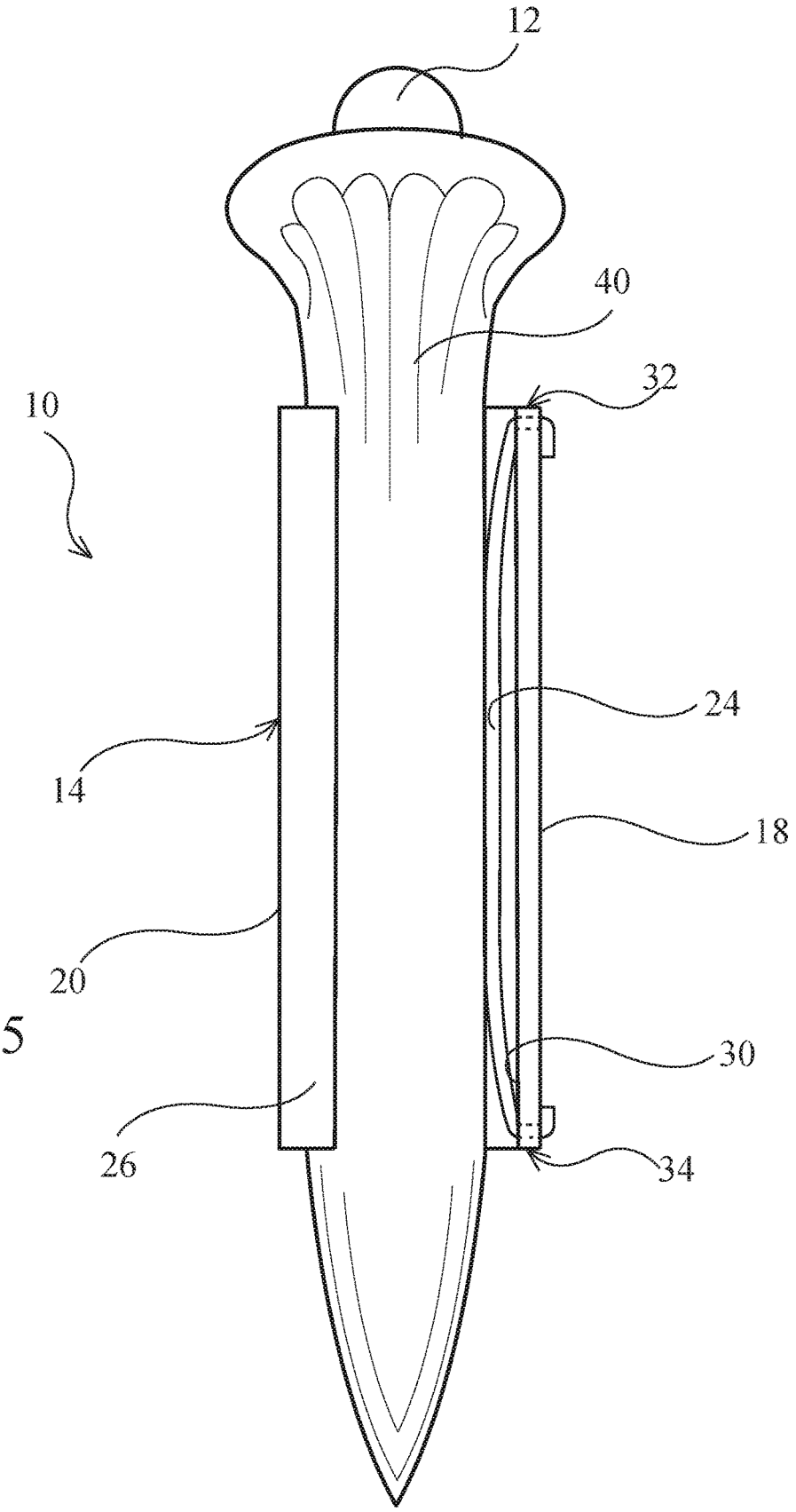
FIG. 5 is an elevation view of the tool of FIG. 1 partially releasing the railway spike.
Figure 6:
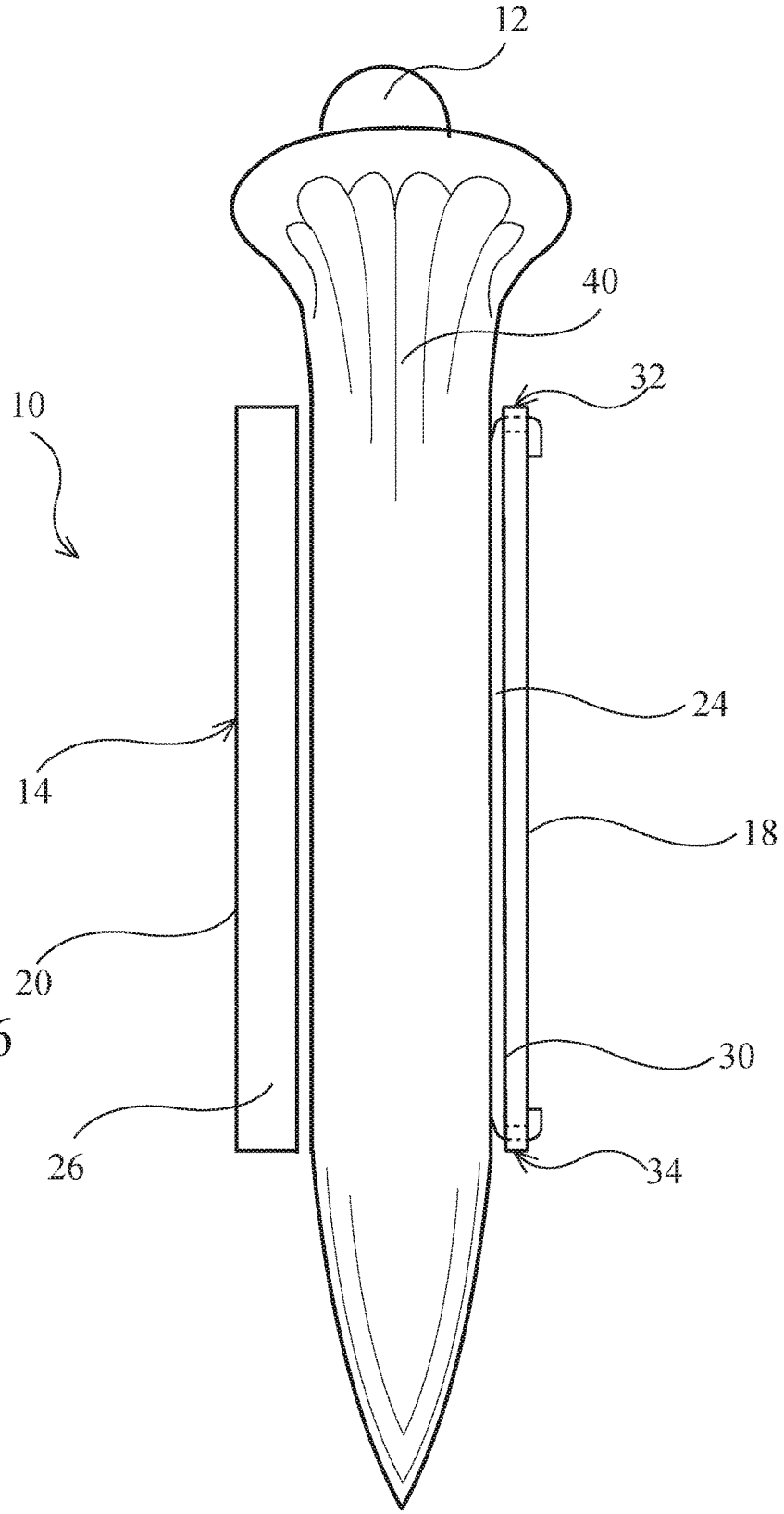
FIG. 6 is another elevation view of the tool of FIG. 1 releasing the railway spike.
Figure 7:
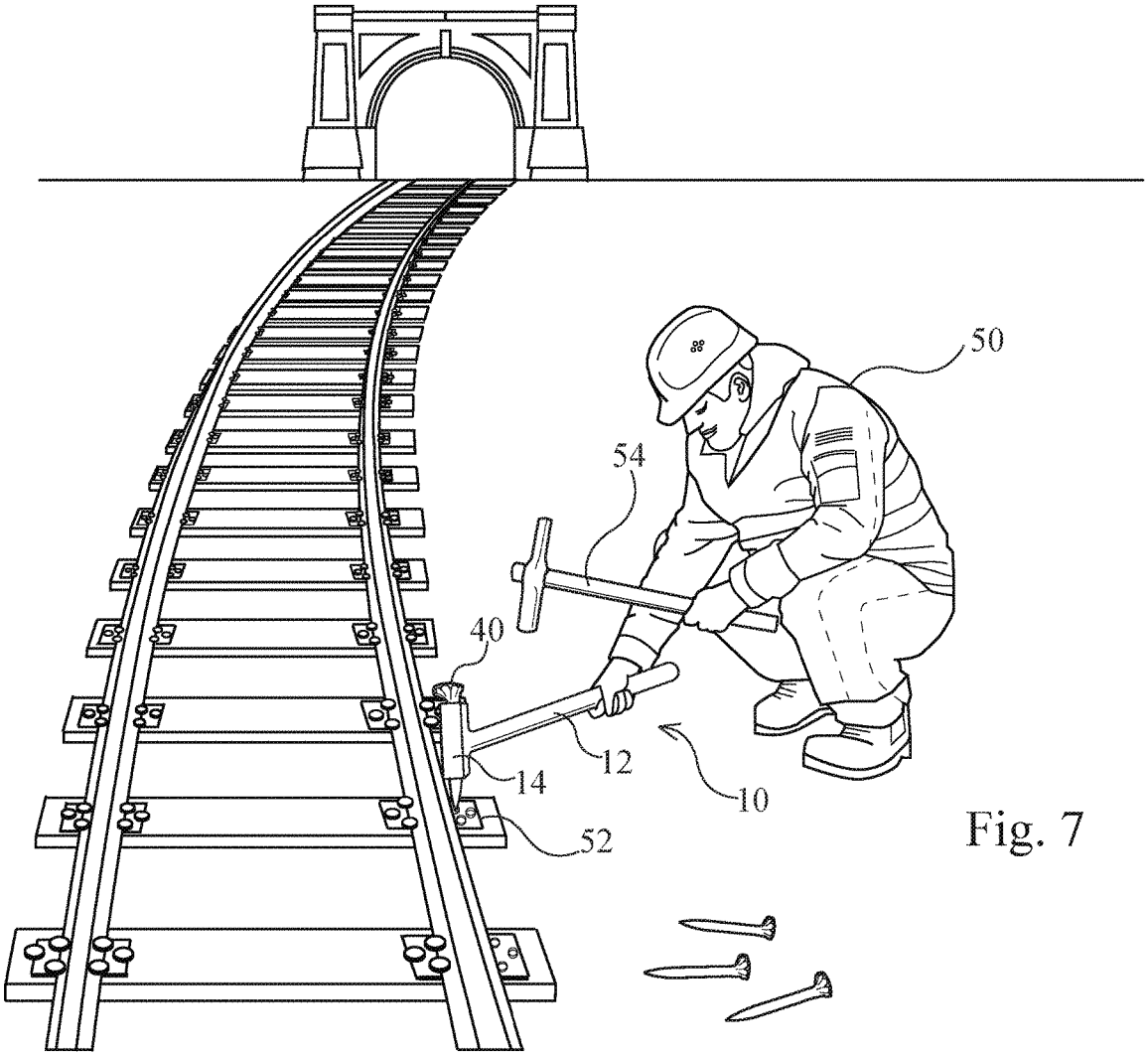
FIG. 7 is a perspective view showing the tool of FIG. 1 being employed to drive the railway spike into a baseplate.

FIG. 3 shows the tool 10 holding a fastener which, in this example, is a railway spike 40 received in the channel 22 of the tool head 14. When the railway spike 40 is received in the channel 22 of the tool head 14, and as best shown in FIG. 4, the spring 24 biases the railway spike 40 to abut the inner surface 36 of the second side wall 20. This securely but releasably holds the railway spike 40 in the channel 22 of the tool head 14. In order to release the railway spike 40, and as best shown in FIGS. 5 and 6, the tool 10 is pivoted relative to the railway spike 40. This results in compression of the spring 24 and a gap forming between the inner surface 36 of the second side wall 20 and the railway spike 40. The gap allows the railway spike 40 to clear the lip 26 of the second side wall 20 which allows the railway spike 40 to be released as best shown in FIG. 6. This is possible because of the play permitted between the railway spike 40 and the spring 24. Referring now to FIG. 7, the tool 10 may be employed by a first workman 50 to position the railway spike 40 to be driven into a baseplate 52 with a sledgehammer 54.

Figure 8:
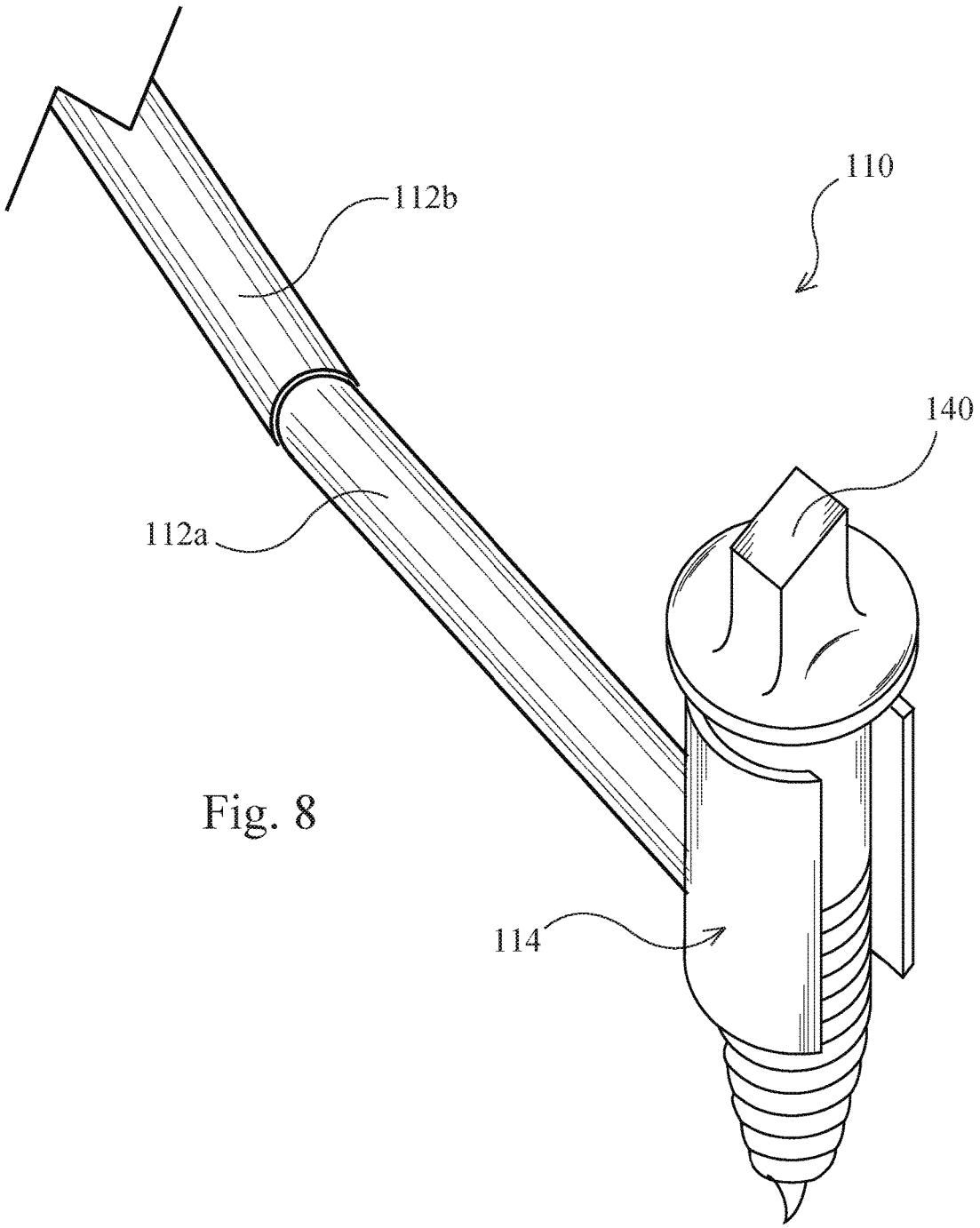
FIG. 8 is a perspective view of another tool for holding a fastener.
Figure 9:
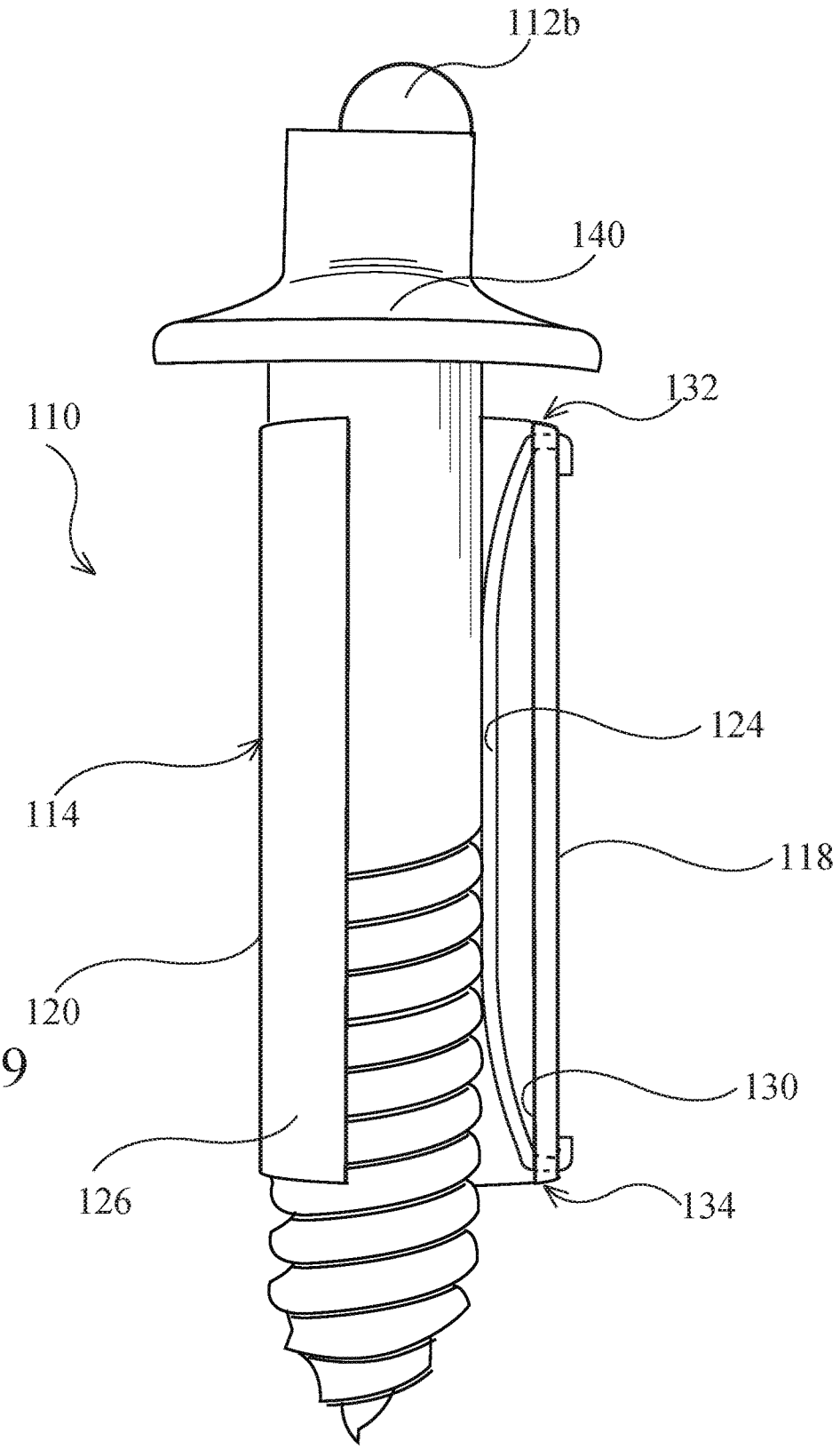
FIG. 9 is a perspective view of the tool of FIG. 8 holding a railway screw.
Figure 10:
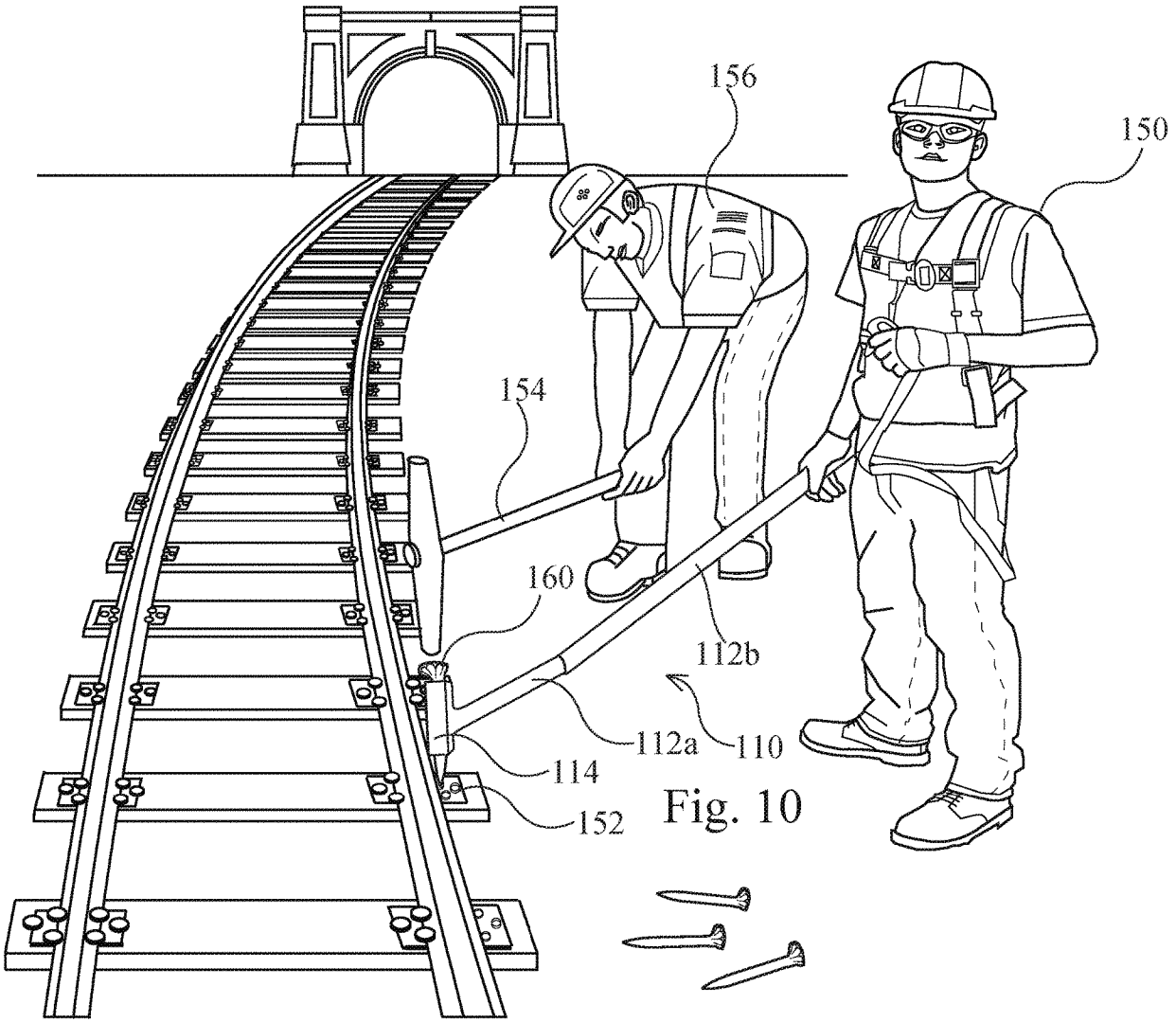
FIG. 10 is a perspective view showing the tool of FIG. 8 being employed to drive the railway spike into a baseplate.

Another tool 110 for holding a fastener is shown in FIG. 8. The tool 110 is generally similar in function to the tool 10 shown in FIG. 1 and comprises a handle, with a distal portion 112*a* and a proximal portion 112*b* which are angularly disposed relative to one another, and a tool head 114. However, in this example and as best shown in FIG. 9, the tool head 114 has a channel defined by a substantially tubular wall having diametrically opposed wall portions 118 and 120. There is a resilient member 124 disposed at the wall portion 118 and a lip portion 126 extending from the wall portion 120. The resilient member 124 extends along a length of the inner surface 130 of the wall portion 118 and is retained by recesses 132 and 134 in the top and bottom edges of the wall portion 118. The tool 110 is shown holding a fastener which in this example is a screw 140 used with bridge ties and/or baseplates. Referring now to FIG. 10, the tool 110 may be employed by a first workman 150 to position a fastener, which in this example is a rounded spike 160, to be driven into a baseplate 152 with a sledgehammer 154 by a second workman 156.

It will be understood by a person skilled in the art that the tool disclosed herein may be used with different types of fasteners having different shapes.

It will be further understood by a person skilled in the art that many of the details provided above are by way of example only, and are not intended to limit the scope of the invention which is to be determined with reference to the following claims.

What is claimed is:

1. A tool for releasably holding a fastener, the tool comprising:

a handle defining a handle axis; and a tool head connected to an end of the handle, the tool head having a channel for receiving a fastener, the tool head comprising:

a first flat wall, a second flat wall, and a third flat wall, each of the first and second flat walls connected to and extending perpendicularly away from the third flat wall and parallel to the handle axis to define the channel, the channel defining a longitudinal channel axis, a spring disposed along a length of an inner surface of the first flat wall, the length being parallel to the longitudinal channel axis, the spring received in a first notch at a first end of the inner surface and in a second notch at a second end of the inner surface, the spring configured to engage and hold the fastener against the second flat wall, and a lip disposed along a longitudinal length of the second flat wall, the longitudinal length being parallel to the longitudinal channel axis, the lip extending perpendicularly away from the second flat wall and toward the first flat wall to define a distal portion of the channel.

2. The tool as claimed in claim 1 wherein the spring is configured to exert a force perpendicular to the second flat wall.

* * * * *